US006601950B2

(12) United States Patent
Hollands et al.

(10) Patent No.: US 6,601,950 B2
(45) Date of Patent: Aug. 5, 2003

(54) MELTING DEVICE AND AN INKJET PRINTER PROVIDED WITH A MELTING DEVICE OF THIS KIND

(75) Inventors: Peter Joseph Hollands, Baarlo (NL); Gerardus Johannes Catharina Mooren, Venlo (NL); Hans Reinten, Velden (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 09/773,919

(22) Filed: Feb. 2, 2001

(65) Prior Publication Data

US 2002/0003563 A1 Jan. 10, 2002

(30) Foreign Application Priority Data

Feb. 4, 2000 (NL) ..... 1014294

(51) Int. Cl.[7] ..... B41J 2/175
(52) U.S. Cl. ..... 347/88
(58) Field of Search ..... 347/88, 85

(56) References Cited

U.S. PATENT DOCUMENTS

| | | | | |
|---|---|---|---|---|
| 4,667,206 A | | 5/1987 | DeYoung | 347/88 |
| 4,682,187 A | | 7/1987 | Martner | 347/88 |
| 5,030,972 A | | 7/1991 | Miyazawa et al. | 347/88 |
| 5,557,305 A | * | 9/1996 | Hine et al. | 347/17 |
| 5,920,332 A | | 7/1999 | Brooks | 347/85 |
| 6,183,060 B1 | * | 2/2001 | Tokuda | 347/33 |

FOREIGN PATENT DOCUMENTS

| | | |
|---|---|---|
| EP | A2780233 | 6/1997 |
| EP | A1924082 | 6/1999 |
| EP | A2933217 | 8/1999 |

* cited by examiner

*Primary Examiner*—Shih-Wen Hsieh
(74) *Attorney, Agent, or Firm*—Birch, Stewart, Kolasch & Birch, LLP

(57) ABSTRACT

A melting device for melting an ink unit used in an inkjet printer, including a melting chamber provided with a wide end for dispensing the ink unit to the melting chamber and a narrow end, the melting chamber having a form such that the ink unit moves, as a result of melting, in a direction from the wide end to the narrow end, the ink unit being laterally enclosed with respect to said direction by one or more walls of a melting chamber, wherein the walls which form a lateral enclosure for the ink unit are heated, during the melting, to above a temperature at which the ink is liquid.

12 Claims, 6 Drawing Sheets

MELTING DEVICE AND AN INKJET PRINTER PROVIDED WITH A MELTING DEVICE OF THIS KIND

BACKGROUND OF THE INVENTION

The present invention relates to a melting device for melting a unit of ink for use in an inkjet printer, comprising a melting chamber provided with a wide end for dispensing the unit of ink to the melting chamber and to a narrow end thereof. The melting chamber has a form such that the ink unit moves, as a result of melting, in a direction from the wide end to the narrow end, the ink unit being laterally enclosed with respect to this direction by one or more walls of the melting chamber. The present invention also relates to an inkjet printer provided with a melting device of this kind.

This melting device is known from U.S. Pat. No. 5,030,972. The melting device is used to provide the inkjet printer printhead, which uses hot-melt melt ink, with liquid ink. Hot-melt ink, also known as phase-change ink, is an ink which is solid under normal ambient conditions but liquid at an elevated temperature. To enable this ink to be transferred to a receiving material by means of the inkjet printer printhead, the ink must be made liquid. During printing, the liquid ink is ejected in the form of individual droplets by the printhead in the direction of the receiving material. In this way, an image built up of a number of separate dots is formed on the receiving material. In order to melt the solid ink as quickly as possible without the need for considerable power, a solid unit of ink in the known device is brought into direct contact with a heater, which also keeps the ink liquid in the printhead. To achieve this, the melting chamber is formed into a constriction by a first vertical wall which acts as a heater (hereinafter referred to as the melting wall) and a second wall, and at an angle thereto which serves to keep the ink unit in contact with the melting wall. When an ink unit is dispensed into the melting chamber via the wide end of the constriction it is enclosed by the two walls. The ink unit melts there where it is in contact with the vertical melting wall, which is heated to above the temperature at which the ink is a liquid. As a result of this melting, the dimensions of the ink unit decrease, so that after the melted ink has been discharged it moves in the direction of the narrow end. In these conditions the melted ink is discharged through the small perforations in the melting wall. The transport of the ink through these perforations takes place by capillary forces.

A melting device of this kind has a significant disadvantage. Since the passage of melted ink to the inkjet head is dependent on the capillary action of the perforations in the vertical melting wall, the maximum speed at which melted ink can be supplied to the printhead is relatively low. This gives rise to problems, particularly if there is a considerable demand for liquid ink, for example if the inkjet printer has to print an illustration with a high degree of coverage, particularly a colored poster. An inadequate supply of melted ink can lead to the liquid ink in the printhead becoming exhausted, so that printing must be temporarily interrupted, which is a disadvantage with respect to inkjet printer productivity. Another problem that may arise in this connection is the inclusion of air bubbles in the liquid ink, which has a very adverse effect on the printing behavior of the printhead. An additional disadvantage of the low speed at which liquid ink is fed through the perforations is that a thin layer of liquid ink will form between the vertical melting wall and the solid ink unit. A layer of liquid ink of this kind forms a thermal barrier, so that the ink will melt more slowly under otherwise identical conditions. It is also a disadvantage with respect to the supply of melted ink to the printhead.

SUMMARY OF THE INVENTION

The object of the melting device according to the present invention is to obviate these disadvantages. To this end, a melting device is invented in which each of the one or more walls of the melting chamber is heated, during the melting process, to above the temperature at which the ink is liquid. It has surprisingly been found that in this way the supply of melted ink increases very considerably. In a melting device according to the invention in which the solid ink unit is heated to above its melting point at all places where it is enclosed by the one or more walls of the melting chamber, extra driving forces are apparently brought into play which cause the melted ink to be discharged at an accelerated rate. The reason for this highly accelerated supply is not completely clear, but closer research has indicated a number of possible causes. Firstly, an ink unit melted from a number of sides will decrease in its structure more rapidly, so that the unit can move more rapidly in the direction of the narrow end of the melting chamber. In the melting device according to the present invention, this movement is made possible by the fact that the unit of solid ink is enclosed only laterally with respect to the direction of movement, i.e. there is no support in a plane perpendicular to the direction of movement which would obstruct the movement of the ink unit. The movement results in a driving force which presses the already melted ink out of the contact surface between the solid ink unit and the melting wall. In addition, as a result of the more rapid movement, the ink unit will come into contact with a "fresh" melting wall surface at an earlier time. Since the thermal conductivity coefficient of the melting wall has a finite value, this means that the fresh melting wall surface has a higher temperature than the melting wall surface which has previously already given up its heat. Here again, the supply of melted ink can be further increased. An additional advantage of this is that the value of the thermal conductivity coefficient of the melting walls is less critical. In addition to the above-mentioned effects which already reinforce one another, it has been found that when an ink unit is laterally enclosed by one or more walls of the melting chamber, the solid ink unit is frequently pressed into contact on at least a part of the melting wall surface with a force greater than the force of gravity acting on the ink unit. A more powerful contact pressure force of this kind ensures that the melted ink is pressed more rapidly out of the contact surface, and this means an extra driving force for the transport of the already melted ink together with a reduction of the thermal barrier between the solid ink unit and the melting wall. These effects appear to reinforce one another in such a manner that a considerable supply of melted ink can be obtained. In addition to these effects, there are probably other causes whereby the supply of melted ink in a melting device according to the invention is considerable. However, knowledge of this is of secondary importance to the successful application of the invention.

In a preferred embodiment, the solid ink unit moves in the melting chamber by the force of gravity. This can be achieved by so disposing the melting chamber with respect to the gravity field that a nett force forms on the solid ink unit in the direction of the narrow end of the constriction. In this way no additional means are required to move the ink unit in the direction of the narrow end. Such means, for example in the form of a spring, not only increase the cost price of the melting device but also have the disadvantage that the dispensing of a following solid ink unit is rendered difficult. In the example given, the spring will have to be pressed in to place a new ink unit between the one or more melting walls of the melting chamber and the spring itself.

In a further, preferred embodiment, the melting chamber comprises, in the vicinity of the narrow end, at least one passage opening for the passage of melted ink. As a result of the provision of the passage opening, the melted ink which will move towards the narrow end under the influence of the force of gravity can leave the melting chamber. Transport of the melted ink will then take place so that it will finally reach the printhead.

In a further preferred embodiment, the melting chamber has an apex angle of less than 60°. This means that in the cross-section of the melting chamber parallel to the direction in which the solid ink unit is moved during melting there will be at least one place where the walls are at an angle of less than 60°. In this embodiment the melting chamber has the advantage that the contact pressure force acting on the solid ink unit perpendicularly to the one or more melting walls is greater than the force of gravity acting on the ink unit. As a result of this increased contact pressure force, melted ink is removed from the contact surface between the one or more melting walls and the solid ink unit at a faster rate. In addition, in a melting device of this kind, the contact surface between the solid ink unit and the one or more melting walls is increased, and this makes possible a further increase in the supply of melted ink. The combination of the two effects ensures that the speed at which a solid ink unit is melted increases greatly in a melting device according to this preferred embodiment.

In yet another preferred embodiment, the melting chamber has an apex angle of less than or equal to 40°. The contact pressure force and the contact surface is thus increased further. In addition, in a melting chamber of this kind, which is constricted relatively slowly, the distance covered by a melting ink unit is relatively considerable during melting. This means that room is readily made available in the melting chamber for a new solid ink unit to be dispensed, so that the supply of melted ink can be further increased.

In yet another preferred embodiment, the apex angle is greater than or equal to 5° and less than or equal to 25°. When the apex angle is greater than or equal to 5°, the melting chamber can be made smaller for given dimensions of the solid ink unit, i.e. the distance between the wide end and the narrow end does not have to be as long. For a given length of the melting chamber, an apex angle greater than or equal to 5° means that ink units of larger dimensions can be dispensed in the chamber. Utilizing an apex angle of less than or equal to 25°, a solid ink unit will move during melting more rapidly in the melting chamber.

In yet another preferred embodiment, the melting chamber has an apex angle greater than or equal to 12° and less than or equal to 17°. This gives an optimum melting chamber in which the solid ink unit can be rapidly melted and an ink unit of sufficiently large dimensions can be dispensed in the chamber without the chamber requiring excessively large dimensions.

In one preferred embodiment, the melting chamber has means for discharging melted ink to the passage opening. This has two advantages. Firstly, the melted ink is then removed from the contact surface even faster, so that the thermal barrier between the melting walls and the solid ink unit becomes even smaller. On the other hand, this prevents the melted ink, which has a density less than that of the solid ink unit, from being pressed in the direction of the wide end. The consequence of this, in fact, would be that the solid ink unit would act as a plug in the melting chamber, with a quantity of melted ink collecting above the plug. This would not only temporarily interrupt the flow of melted ink to the passage opening and hence also to the inkjet head, but in addition the melting of the last solid ink of the plug might result in a sudden large supply of melted ink at the passage opening. A discontinuous supply of melted ink in this way is difficult to control. By the provision of the discharge means according to the invention, each recess formed in the wall surface of the one or more melting walls, particularly perforations, ribs, slots, grooves, ducts or a certain roughening, there forms in the melting chamber a continuous flow of melted ink to the passage opening. In a further preferred embodiment the discharge means comprise a slot formed in the one or more melting walls of the melting chamber. The slot has the advantage that it can be made so deep that a melting ink unit cannot practically assume a form such that the slot is completely filled and hence blocked by, as yet, unmelted ink. If the slot is formed helically, so that it does not extend parallel to the direction of movement of the melting solid ink unit, any blockage of the slot as a discharge means for the melted ink is further prevented. In a preferred embodiment, the melting chamber is substantially conical. Such a shape ensures that the ink unit for melting is enclosed on all sides so that the melting speed further increases. In addition, a form of this kind can be obtained simply by means of an injection moulding process.

BRIEF DESCRIPTION OF THE DRAWINGS

The present invention will be explained in detail with reference to the following examples, wherein.

DETAILED DESCRIPTION OF THE INVENTION

Table 1 shows the results of a melting experiment with a number of melting chambers according to the invention.

Figure 1:
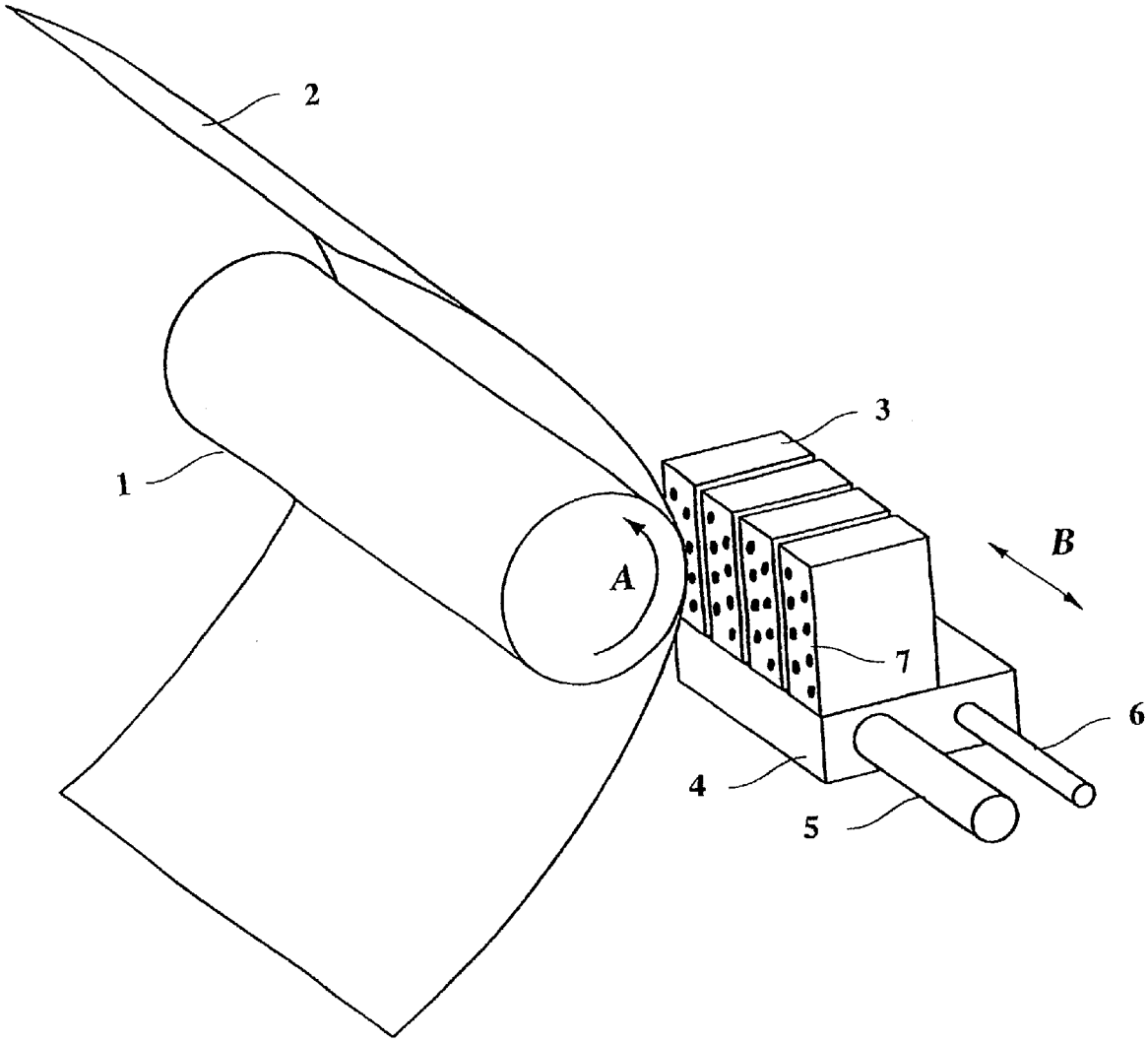
FIG. 1 is an example of an inkjet printer.

FIG. 1 shows an inkjet printer. In this embodiment, the inkjet printer comprises a roller 1 which supports a substrate 2 which is fed along the four printheads 3, one for each of the colors cyan, magenta, yellow and black. The roller 1 is rotatable about its axis as indicated by the arrow A. A scanning carriage 4 carries the four printheads 3 and can be moved in reciprocation in a direction indicated by the double arrow B, parallel to roller 1. In this way the printheads 3 can scan the receiving substrate 2, for example a sheet of paper. The carriage 4 is guided on rods 5 and 6 and is driven by suitable means for the desired purpose (not shown).

In the embodiment as illustrated in the Figure, each printhead comprises eight ink ducts, each with its own nozzle 7, said nozzles forming a row perpendicular to the axis of the roller 1. In a practical embodiment of a printing device, the number of ink ducts per printhead will be many times greater. Each ink duct is provided with means for activating the ink duct (not shown) and an associated electrical drive circuit (not shown). In this way, the ink duct, the ink duct activating means, and the drive circuit form a unit which can serve to eject ink drops in the direction of roller 1. If the ink ducts are activated image-wise, an image forms which is built up of ink drops on substrate 2.

In this example, each printhead 3 is provided with the melting device according to the present invention (not shown). Each melting device is integrated in the corresponding printhead. The printer contains a supply of solid ink units, for example in the form of ink pellets. If the printhead needs melted ink, a solid ink unit can be dispensed, by means known per se, via the dispensing station, to the melting chamber of the melting device. After the ink is melted, it can be conveyed further to the ink ducts.

Figure 2A:
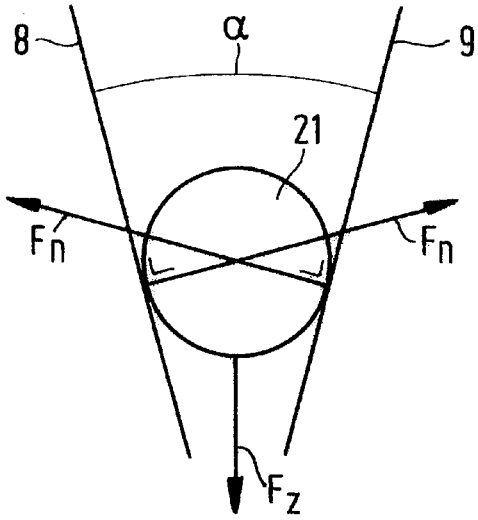
FIG. 2, which is made up of FIGS. 2*a* and 2*b*, diagrammatically illustrates an ink unit enclosed laterally by two melting walls.
Figure 2B:
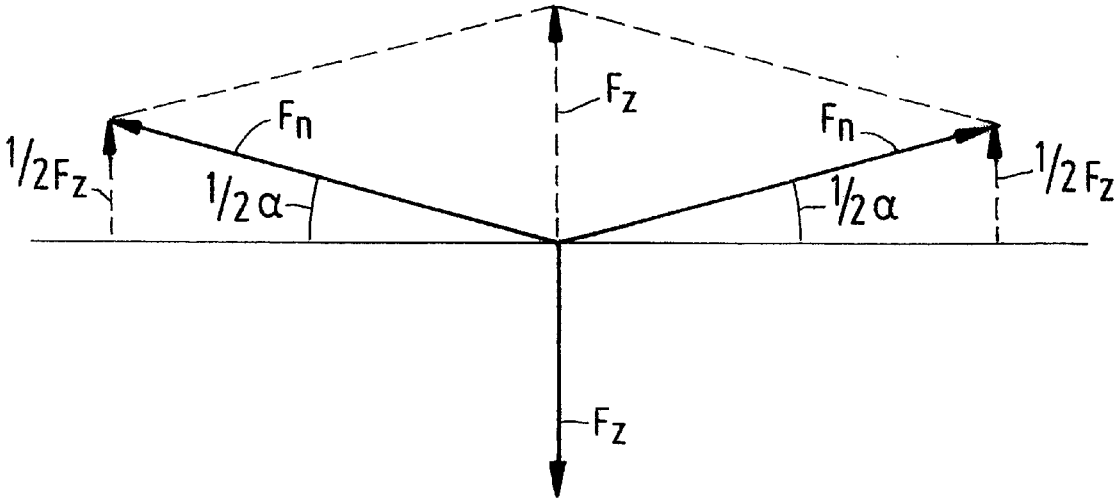

FIG. 2 is made up of FIGS. 2*a* and 2*b*. FIG. 2*a* diagrammatically illustrates a solid ink unit 21 laterally enclosed by two melting walls 8 and 9 of the melting chamber, which has a distinct apex angle α. For simplification, the melting chamber is disposed vertically. The solid ink unit experiences a gravity force Fz. In a stationary condition, for example, when the ink unit is not moving, the gravity force is compensated by other forces. If we assume that the frictional force between the ink unit and the walls is negligible, and this is acceptable under the conditions in which a thin layer of melted ink is situated between the solid ink unit and the walls, the gravity force is compensated by the two normal forces Fn which the walls 8 and 9 exert on the ink unit.

FIG. 2*b* shows the associated force balance. It will be apparent from this that the normal force exerted on the unit by each wall has a vertical component equal to half the gravity force. In this way the net force exerted on the unit becomes nil.

From FIG. 2*b*, the relation between the normal force and the gravity force can be derived as follows:

$$\sin(\tfrac{1}{2}\alpha)=(\tfrac{1}{2}*Fz)/Fn \quad (1)$$

so that $$Fn=\tfrac{1}{2}*Fz/\sin(\tfrac{1}{2}\alpha) \quad (2)$$

From this relationship it follows that under the given conditions the normal force is greater than the gravity force as soon as the apex angle α is less than 60°. Since the normal force is equal to the force by which the ink unit is pressed against the respective melting walls 8 and 9, this means that the contact pressure force increases with respect to the gravity force as soon as the apex angle of the constriction in the melting chamber is less than 60°.

The advantage of a greater contact pressure force of this kind is that the melted ink is removed more rapidly from the contact surface between the ink unit and the melting walls without additional contact pressure means having to be used.

Figure 3A:
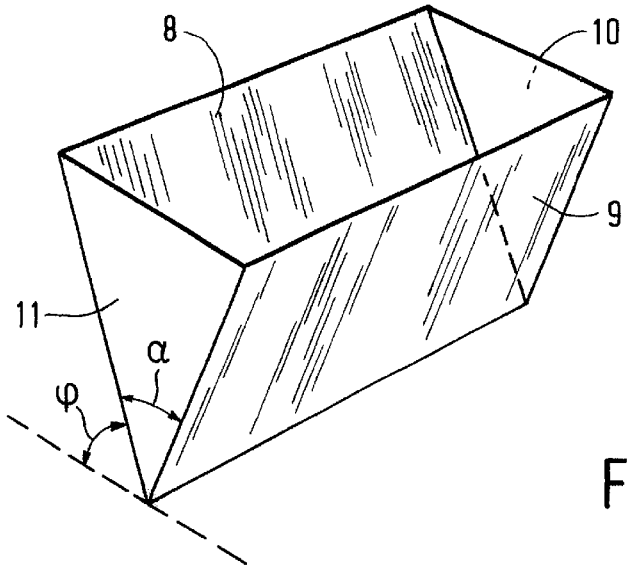
FIG. 3, which is made up of FIGS. 3*a*, 3*b* and 3*c*, diagrammatically illustrates a number of possible melting chambers.
Figure 3B:
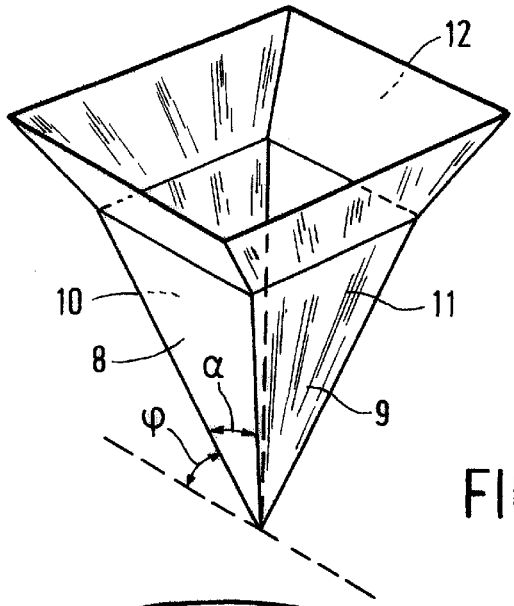
Figure 3C:
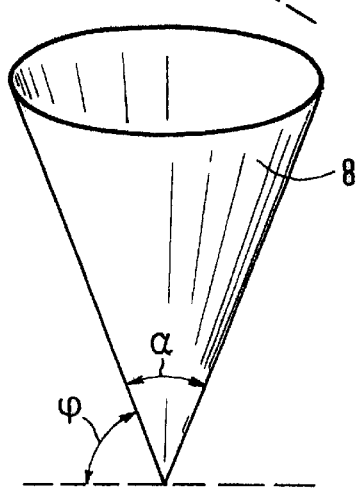

FIGS. 3*a*, 3*b* and 3*c* diagrammatically illustrate a number of examples of possible melting chambers formed into a constriction. FIG. 3*a* shows a wedge-shaped chamber in which the constriction is formed by the walls 8 and 9 in such a manner that the constriction has an apex angle α (corresponding to an angle of inclination ν of the wedge). At the ends, the chamber is closed by the walls 10 and 11. With a melting chamber formed in this way, the solid ink unit is dispensed at the wide end of the wedge, whereafter the ink unit will be laterally enclosed by the walls 8 and 9. In this case it is advantageous to select a size for the solid ink unit such that the unit is already engaged by the walls 8 and 9 in the vicinity of the wide end. By heating the walls 8 and 9 above a temperature at which the ink is liquid, the solid ink unit will melt at the contact surface with the walls 8 and 9 so that the ink unit will rapidly assume the shape of the wedge. During the melting process, the melted ink will leave the contact surface quickly as a result of the pressure exerted by the solid ink unit on the melting walls 8 and 9, so that the solid ink unit will move in the direction of the narrow end of the wedge. In a practical embodiment of the melting chamber, there will be at least one passage opening in the vicinity of the narrow end to feed the melted ink to the inkjet head. As soon as the solid ink unit has melted sufficiently, i.e. it has covered a distance in the direction of the narrow end such that there is again room in the melting chamber for another solid ink unit, a subsequent ink unit can be dispensed.

FIG. 3*b* shows a melting chamber made up of a first truncated pyramid 12 and a second pyramid with an apex angle α, which second pyramid is formed by the walls 8, 9, 10 and 11. In this configuration, the walls 8, 9, 10 and 11 of the melting device are heated so that the second pyramid forms the melting chamber. The first pyramid can serve, for example, as a dispensing station to facilitate dispensing of a solid ink unit.

FIG. 3*c* shows a third possible form of a melting device in which the melting chamber has the form of a cone with an apex angle α, said cone being formed by the wall 8. A solid ink unit dispensed to a chamber of this kind will be enclosed by the wall 8. When the wall is heated the ink will melt and the ink unit will move in the direction of the narrow end of the cone.

The above-described forms are given purely for illustration. Each form in which the melting chamber is anywhere shaped to form a constriction in which the walls which enclose the ink unit are heated in order to melt this unit, form part of the invention. Thus melting chambers are possible in the form of a prism or prismoid, a parabola of revolution, an ellipsoid, and so on. In particular, there is no need for a constriction such as to form one distinct apex angle. It is quite possible for the angle formed by the wall (as in the case of a conical shape) or walls (as in the case of a pyramid) in a cross-section parallel to the direction of movement of the solid ink unit to change continuously (as in the case of a parabola of revolution) or discontinuously (as in the case of the double pyramid shown in FIG. 3*b*) extending from the wide end to the narrow end of the melting chamber.

Figure 4:
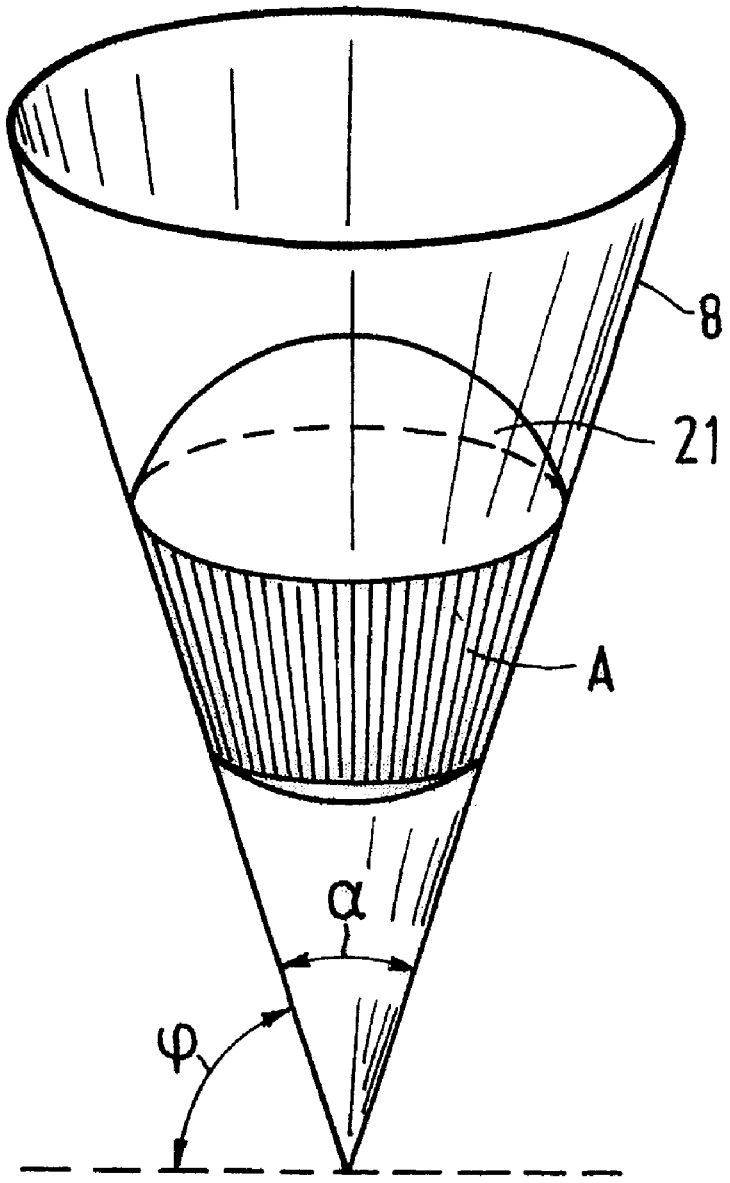
FIG. 4 diagrammatically illustrates a conical melting chamber in which a melting unit of solid ink is located.

FIG. 4 diagrammatically illustrates a conical melting chamber in which a solid ink unit (21) is located. At the time when the solid ink unit is dispensed into the melting chamber via the wide end, the said unit has the form of a sphere. By making contact with the heated wall (8) of the melting chamber, which wall forms the cone, the spherical ink pellet rapidly, gradually assumes the shape of the cone so that the large contact surface A forms between the ink pellet and the wall. The ink pellet will melt rapidly as a result of this relatively large contact surface. As the angle ν increases, the melting ink pellet will also move more quickly in the direction of the narrow end of the melting chamber so that there is more room for the dispensing of a new ink pellet. In one practical embodiment of this melting chamber, the point of the cone can be removed so as to form a passage opening.

Figure 5A:
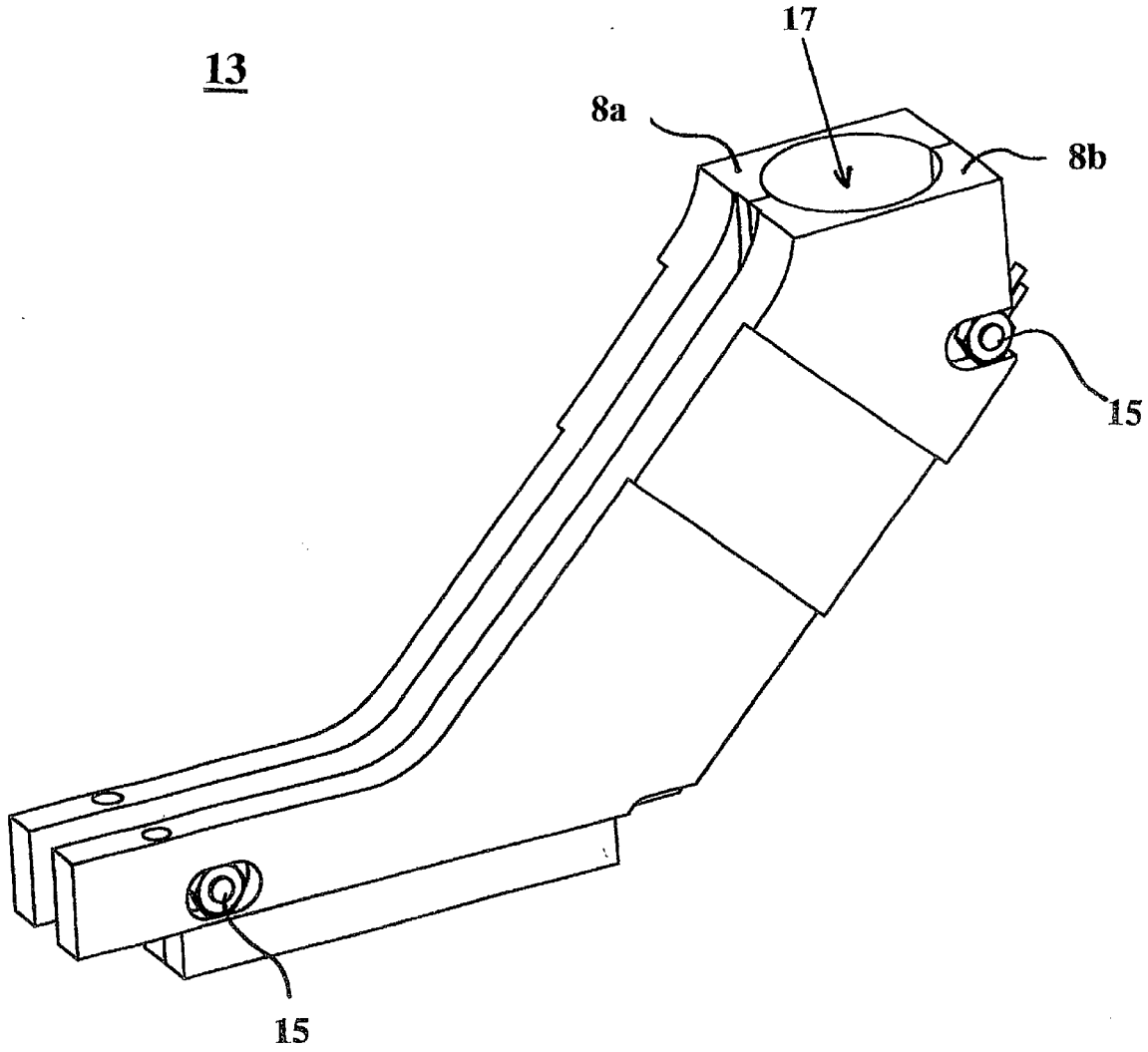
FIG. 5A is an example of a melting chamber according to a preferred embodiment of the invention.
Figure 5B:
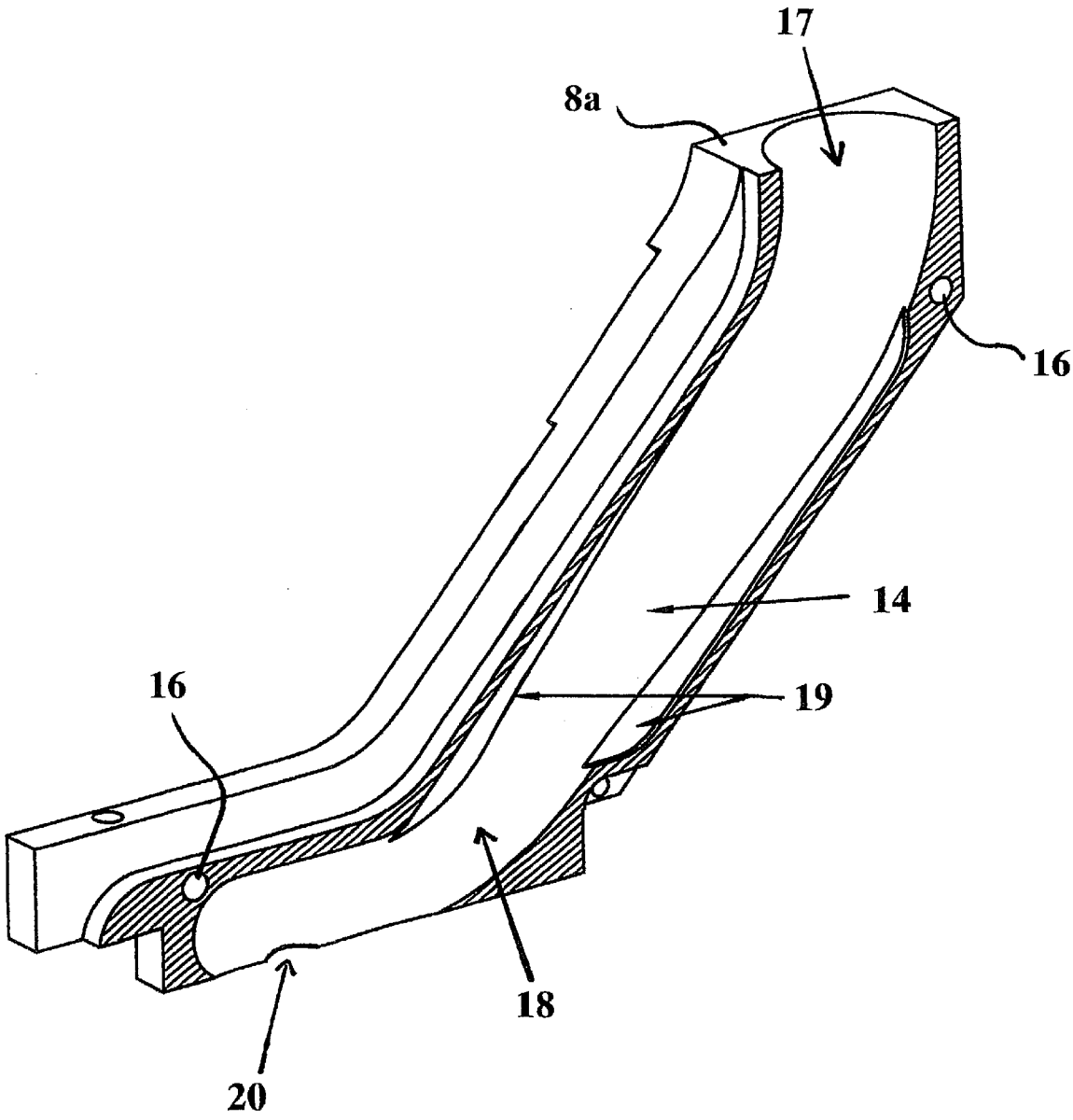
FIG. 5B shows the melting chamber of FIG. 5A in cross-section.

FIG. 5A is an example of an embodiment of a melting device according to the present invention. FIG. 5A shows the melting device (13) made up of the parts 8*a* and 8*b*. The part 8*a* of the melting device is shown in cross section in FIG. 5B. In this embodiment, the melting device is made up of two identical parts 8*a* and 8*b* which together form the wall of the conical melting chamber 14. In this example the parts 8*a* and 8*b* are formed entirely of heat-conducting material, e.g. aluminium. The melting device is provided with heating means (not shown) which heat the parts 8*a* and 8*b* to above the melting point of the ink for melting the ink. These means are sufficiently known from the prior art and require no further explanation here.

The parts are interconnected by fixing means 15, made up in this example of studs and nuts co-operating therewith, said studs fitting in holes 16 formed in the parts 8*a* and 8*b*. The conical melting chamber is provided with a wide end 17 and a narrow end 18. The dispensing station (not shown) is situated in the vicinity of the wide end, just outside the actual melting chamber. A solid ink unit, for example in the form of a spherical ink pellet, is dispensed in the wide end and comes into contact with the heated wall, formed by the two parts 8*a* and 8*b*. Part of the ink unit will melt as a result. As a result of the relatively high contact pressure force experienced by the melted ink, the latter is pressed out between the ink unit and the wall and reaches the discharge means 19, which in this example is formed by two slots in the parts 8*a* and 8*b*. The melted ink can move via the slots in the direction of the narrow end in order then to reach the passage opening 20. The liquid ink will leave the melting device via this passage opening. During the melting process the solid ink unit will become increasingly smaller and move in the direction of the narrow end. When it arrives there the remaining part of the ink pellet will melt further, the melted ink leaving the melting device via the passage opening.

Table 1

Table shows the results of a melting experiment with a number of melting chambers according to the present invention. Seven conical melting chambers were used for this experiment each having a different apex angle, namely an apex angle of 30° from the first melting chamber to an apex angle of 5° for the seventh melting chamber. The melting chambers are made of aluminium, made up of two identical parts (similar to the example shown in FIG. 5) and provided with heating means so that their temperature can be maintained constant at 125° C. The melting chambers are disposed vertically and are each provided with four slots in the longitudinal direction on the inside in order to feed the melted ink to the passage opening, this being formed by removing the top of each cone. The resulting passage opening has a cross-section of approximately 1 mm.

The melting experiment was carried out by always dispensing a round ink pellet having a mass of approximately 1 gram in each melting chamber, the ink pellet comprising a meltable mixture with a density of approximately 1.1 g/cm3. The mixture starts to melt at approximately 70° C. Beneath each melting chamber is a mass balance, with which the melted ink output can be accurately determined. The experiment was so performed that whenever a previously dispensed ink pellet had practically completely melted, a following ink pellet was dispensed.

The melting output possible was determined in this way for each melting chamber. The values obtained are shown in Table 1. The second column gives the apex angle of the corresponding melting chamber. Column 3 gives the measured melting output in grams per minute. Column 4 gives the melting output in standardised form such that it is equal to 100 units for the maximum melting output measured. Finally, column 5 gives the contact pressure force for each melting chamber, calculated in accordance with formula 2. In this case the value for the contact pressure force is again standardised to 100 units for the melting chamber with the smallest apex angle.

It will be apparent from the Table that the melting output obtained compares reasonably well with the calculated value for the contact pressure force as derived by means of FIG. 2.

TABLE 1

Measured melting output in g/min for seven conical melting chambers in relation to the relative contact pressure force of the ink pellet in the melting chambers.

| Melting chamber # | Apex angle α [°] | Melting output [g/min] | Standardised melting output [-] | Standardised contact pressure [-] |
|---|---|---|---|---|
| 1 | 30 | 2.0 | 9.0 | 17 |
| 2 | 25 | 3.0 | 13 | 20 |
| 3 | 20 | 3.9 | 17 | 25 |
| 4 | 15 | 7.5 | 35 | 33 |
| 5 | 10 | 10 | 43 | 50 |
| 6 | 7.5 | 18 | 78 | 67 |
| 7 | 5.0 | 23 | 100 | 100 |

What is claimed is:

1. A combination of a solid ink unit for use in an ink jet printer and a melting device for melting the ink unit, said melting device comprising a melting chamber provided with a wide end for dispensing the ink unit to the melting chamber and a narrow end, such that during melting, the ink unit moves in a direction from the wide end to the narrow end, wherein dimensions of the ink unit are adapted to the dimensions of the melting chamber such that the ink unit, when dispensed in the melting chamber, is laterally grasped, with respect to the said direction, by one or more walls of the melting chamber, without being supported by a wall of the melting chamber in a plane substantially perpendicular to said direction, whereby, during the melting of the said ink unit, each of said one or more walls is heated to a temperature where the ink is a liquid.

2. The melting device according to claim 1, wherein the ink unit moves by means of the force of gravity.

3. The melting device according to claim 1, wherein the melting chamber is provided with at least one passage opening in the vicinity of the narrow end for the passage of melted ink.

4. The melting device according to claim 3, wherein the melting chamber is provided with means for discharging melted ink to the passage opening.

5. The melting device according to claim 4, wherein the means comprises a slot.

6. The melting device according to claim 5, wherein the slot is disposed in a helical form.

7. The melting device according to claim 1, wherein the melting chamber has an apex angle of less than 60°.

8. The melting device according to claim 7, wherein the apex angle is equal to or less than 40°.

9. The melting device according to claim 8, wherein the apex angle is equal to or greater than 5° and is equal to or less than 25°.

10. The melting device according to claim 9, wherein the apex angle is equal to or greater than 12° and is equal to or less than 17°.

11. The melting device according to claim 1, wherein the melting chamber is conical.

12. An inkjet printer containing at least one print head, said printhead being provided with a combination of a solid ink unit and a melting device for melting the ink unit, said melting device comprising a melting chamber provided with a wide end for dispensing the ink unit to the melting chamber and a narrow end, such that during melting, the ink unit moves in a direction from the wide end to the narrow end, wherein dimensions of the ink unit are adapted to the dimensions of the melting chamber such that the ink unit, when dispensed in the melting chamber, is laterally grasped, with respect to the said direction, by one or more walls of the melting chamber, without being supported by a wall of the melting chamber in a plane substantially perpendicular to said direction, whereby, during the melting of the said ink unit, each of said one or more walls is heated to a temperature where the ink is a liquid.

* * * * *